US006523647B2

(12) United States Patent
Duplessis

(10) Patent No.: US 6,523,647 B2
(45) Date of Patent: Feb. 25, 2003

(54) ELEVATING PLATFORM ASSEMBLY

(75) Inventor: Benoit Duplessis, Montreal (CA)

(73) Assignee: Hydro Mobile Inc., L'Assomption (CA)

( * ) Notice: Subject to any disclaimer, the term of this patent is extended or adjusted under 35 U.S.C. 154(b) by 0 days.

(21) Appl. No.: 09/861,864

(22) Filed: May 21, 2001

(65) Prior Publication Data

US 2002/0170784 A1 Nov. 21, 2002

(51) Int. Cl.[7] ..... B66B 9/02; B66B 11/04

(52) U.S. Cl. ..... 187/270; 187/243; 187/244; 74/29; 74/422; 182/141

(58) Field of Search ..... 187/270, 243, 187/244; 182/141, 146, 148; 414/279, 281; 74/29, 31, 33, 410, 422

(56) References Cited

U.S. PATENT DOCUMENTS

| | | | | | |
|---|---|---|---|---|---|
| 3,016,989 | A | * | 1/1962 | Lindmark | 187/270 |
| 3,313,376 | A | * | 4/1967 | Holland, Sr. | 187/270 |
| 3,415,343 | A | * | 12/1968 | Svensson | 187/270 |
| 3,924,710 | A | * | 12/1975 | Shohet | 187/270 |
| 4,293,054 | A | * | 10/1981 | Pieri | 182/148 |
| 4,516,663 | A | * | 5/1985 | D'Alessio et al. | 187/270 |
| 4,809,814 | A | | 3/1989 | St-Germain | 182/132 |
| 4,967,733 | A | * | 11/1990 | Rousseau | 182/141 |
| 6,261,820 | B1 | * | 4/2001 | Mol | 182/141 |

FOREIGN PATENT DOCUMENTS

| | | | | |
|---|---|---|---|---|
| DE | 4126768 | * | 2/1993 | 187/270 |
| WO | WO 92/06258 | | 4/1992 | |
| WO | WO 99/50167 | | 10/1999 | |

* cited by examiner

*Primary Examiner*—Christopher P. Ellis
*Assistant Examiner*—Paul T. Chin
(74) *Attorney, Agent, or Firm*—Baker & Daniels

(57) ABSTRACT

An elevating platform assembly includes a generally vertical mast having a generally vertical rack mounted thereon. A first trolley is coupled to the mast and is moveable therealong. A drive mechanism is carried by the first trolley and includes at least one pinion in mating engagement with the rack. An elongated elevating platform extends from the mast and has a second trolley mounted adjacent one end thereof. The second trolley couples the elevating platform to the mast and is moveable along the mast. The first trolley is coupled to at least one of the second trolley and elevating platform in a manner to maintain alignment of the at least one pinion and rack when loads are placed on the elevating platform that create moments at the mast.

18 Claims, 5 Drawing Sheets

ELEVATING PLATFORM ASSEMBLY

FIELD OF THE INVENTION

The present invention relates generally to elongated working platforms and in particular to an elevating platform assembly of the type having a rack and pinion drive mechanism.

BACKGROUND OF THE INVENTION

Elongated working platforms are well known in the art and are commonly used during construction to support workers and equipment at desired elevations. Platforms of this nature include stationary scaffolding as well as moveable elevating platform assemblies. Although stationary scaffolding is useful, in many instances it is desired to change quickly the elevation of workers and equipment and thus, elevating platform assemblies are advantageous.

One known type of elevating platform assembly is manufactured by Hydro Mobile of L'Assomption, Quebec. This elevating platform assembly includes an elevating platform that is supported at one end by a mast. A drive mechanism acts between the elevating platform and the mast. The drive mechanism includes a trolley moveable along the mast to which the platform is secured. A motor is mounted on the trolley and drives pinions that cooperate with a rack secured to the mast. In this manner, the elevating platform can be moved upwardly and downwardly along the mast.

Although this elevating platform assembly works satisfactorily, when heavy loads are placed on the elevating platform near its end furthest from the mast, significant torque can be applied to the trolley by the elevating platform. The torque applied to the trolley acts to pull the trolley away from the mast. If the trolley moves relative to the mast under the influence of the torque, misalignment between the teeth of the pinions and the teeth of the rack results. This of course can result in stripping of the pinions as the trolley is advanced along the mast. As will be appreciated improvements to elevating platform assemblies of this nature are desired.

It is therefore an object of the present invention to provide a novel elevating platform assembly of the type having a rack and pinion drive mechanism.

SUMMARY OF THE INVENTION

According to one aspect of the present invention there is provided an elevating platform assembly comprising:

a generally vertical mast having a generally vertical rack mounted thereon;

a first trolley coupled to said mast and being moveable therealong;

a drive mechanism carried by said first trolley, said drive mechanism including at least one pinion in mating engagement with said rack; and an elongated elevating platform extending from said mast and having a second trolley mounted adjacent one end thereof, said second trolley coupling said elevating platform to said mast and being moveable along said mast, wherein said first trolley is coupled to at least one of said second trolley and said elevating platform in a manner to maintain alignment of said at least one pinion and rack when loads are placed on said elevating platform that create moments at said mast.

In one embodiment, the first trolley is coupled to the elevating platform via a shock absorbing arrangement that includes an elastomeric element. The shock absorbing arrangement permits the elevating platform to pivot relative to the first trolley without significant forces being applied to the first trolley that act to pull the first trolley away from the mast.

In another embodiment, the first trolley is positioned on the mast below the second trolley and is coupled to the second trolley through shock absorbing elements carried by at least one of the first and second trolleys.

According to another aspect of the present invention there is provided an elevating platform assembly comprising:

an upright mast having a vertical rack extending along at least one side thereof;

a motor trolley coupled to said mast, said motor trolley carrying a drive mechanism including at least one rotatable pinion in mating engagement with said rack, rotation of said at least one pinion advancing said motor trolley vertically along said mast;

an elongated elevating platform extending from said at least one side of said mast, said elevating platform including a generally horizontal work surface; and a main trolley acting between said elevating platform and said mast and being moveable vertically along said mast, wherein said motor trolley is coupled to one of said main trolley and said elevating platform in a manner so as to maintain alignment of said at least one pinion and said rack when loads are placed on said elevating platform.

The present invention provides advantages in that the coupling between the first trolley and either the second trolley or the elevating platform inhibits the at least one pinion from becoming misaligned with the rack when loads are placed on the elevating platform that create moments at the mast. By maintaining the at least one pinion and rack in alignment regardless of loads placed on the elevating platform, the likelihood of stripping of the teeth on the at least one pinion is reduced.

BRIEF DESCRIPTION OF THE DRAWINGS

Embodiments of the present invention will now be described more fully with reference to the accompanying drawings in which.

DETAILED DESCRIPTION OF THE PREFERRED EMBODIMENTS

Figure 1:
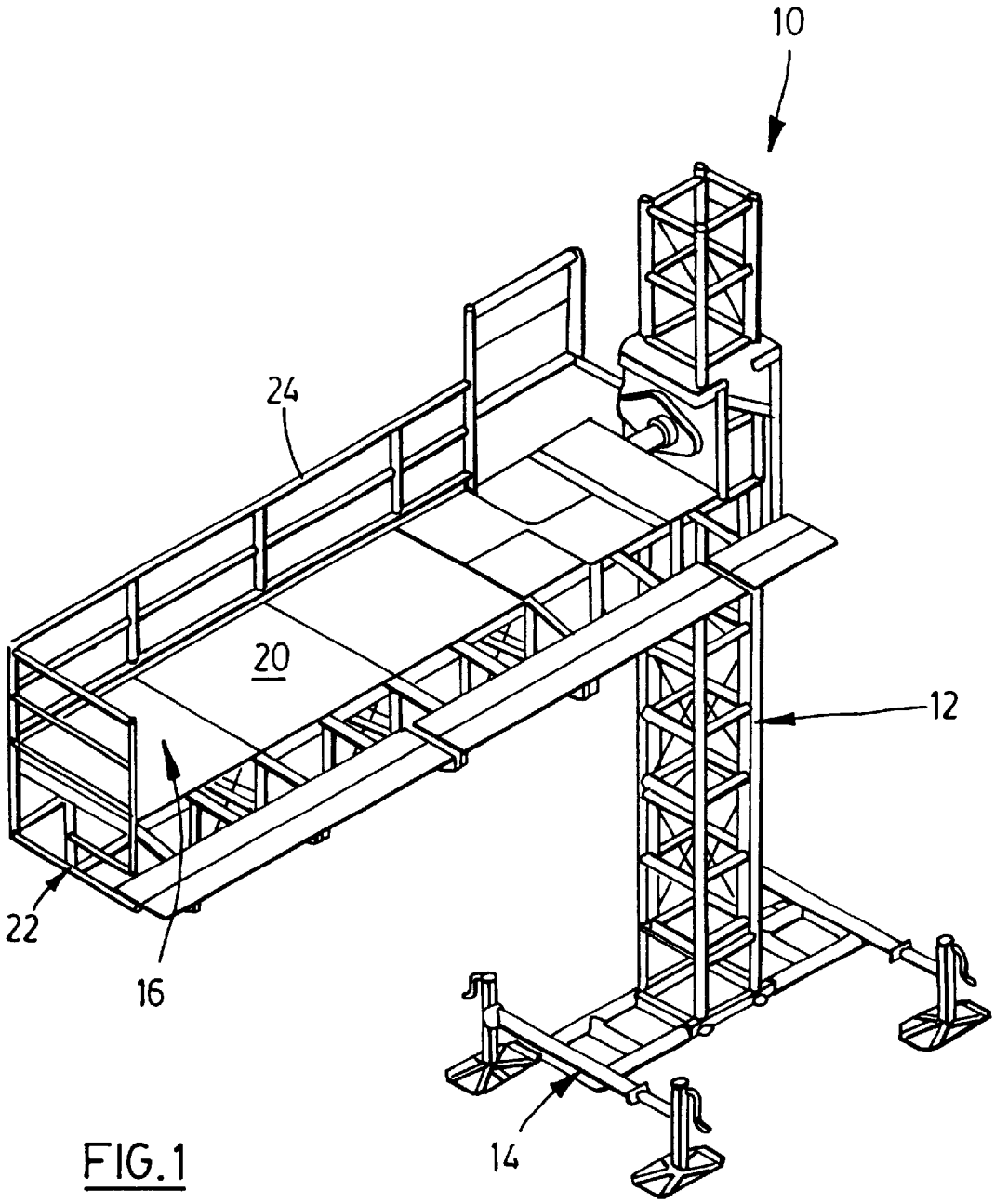
FIG. 1 is an isometric view of an elevating platform assembly in accordance with the present invention.

Referring now to FIG. 1, an elevating platform assembly is shown and is generally identified by reference numeral 10. As can be seen, elevating platform assembly 10 includes a generally vertical mast 12 that is supported by a base assembly 14 resting on a ground surface. An elongate elevating platform 16 extends from one side of the mast 12 generally at a right angle. The elevating platform 16 includes a generally planar work surface 20 secured to an underlying supporting framework 22. Guard rails 24 surround the work surface 20. The elevating platform 16 is coupled to the mast 12 in a manner that permits the elevating platform to move vertically along the mast 12 thereby to allow the work surface 20 to be positioned at desired elevations as will be described.

Figure 2:
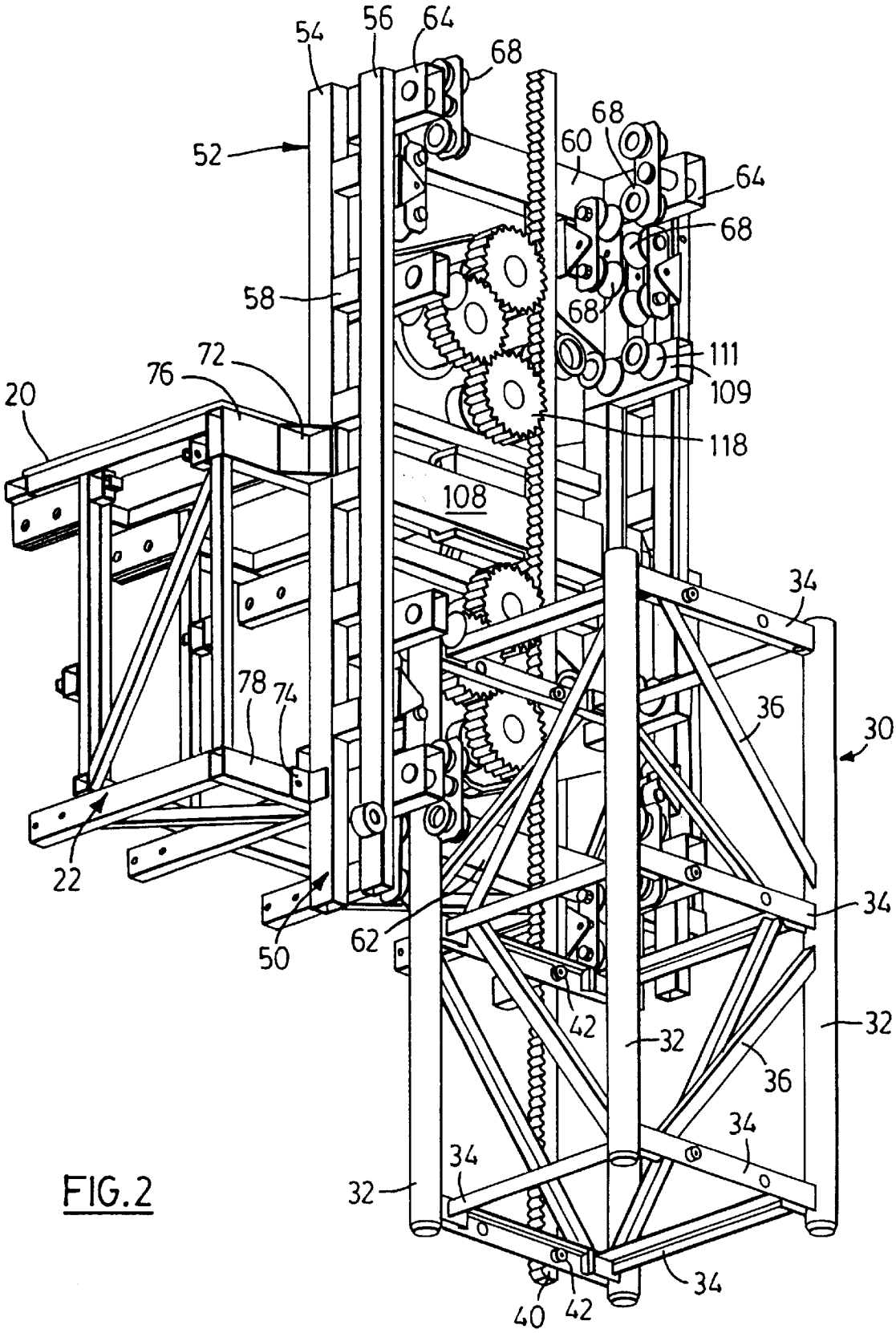
FIG. 2 is an isometric view of a portion of the elevating platform assembly of FIG. 1 showing a motor trolley, main trolley and elevating platform arrangement.

The mast 12 is formed from a series of stacked, box-type mast sections 30, one of which is shown in FIG. 2. As can be seen, mast 12 includes four vertical corner rails 32 joined by horizontal crossbars 34 at vertically spaced locations. A plurality of diagonal cross-members 36 extends between the rails 32 and the horizontal crossbars 34 to provide additional support to the mast 12. A vertical rack 40 is secured to the horizontal crossbars 34 on one side of the mast 12 by suitable fasteners 42.

A main trolley 50 is coupled to the mast 12 and runs along the rails 32 that are on opposite sides of the rack 40. The main trolley 50 includes a generally rectangular frame structure 52. Each side of the frame structure 52 is constituted by a pair of vertical side members 54 and 56 joined together by a series of steps 58. Upper and lower cross members 60 and 62 span the sides of the frame structure 52. A roller set support 64 is positioned at each corner of the frame structure 52 and extends inwardly towards the mast 12. Three sets of rollers 68 are mounted on each support 64. The rollers 68 on the supports 64 surround and engage the rails 32.

The main trolley 50 is secured to the framework 22 of the elevating platform 16 by upper and lower angles 72 and 74 respectively on opposite sides of the main trolley 50. Specifically, the upper angles 72 secure the main trolley 50 to a main upper beam 76 that supports the work surface 20. The lower angles 74 secure the main trolley 50 to a main lower beam 78. Since the elevating platform 16 is fixed to the main trolley 50, the elevating platform and the main trolley 50 move as a unit.

Figure 3:
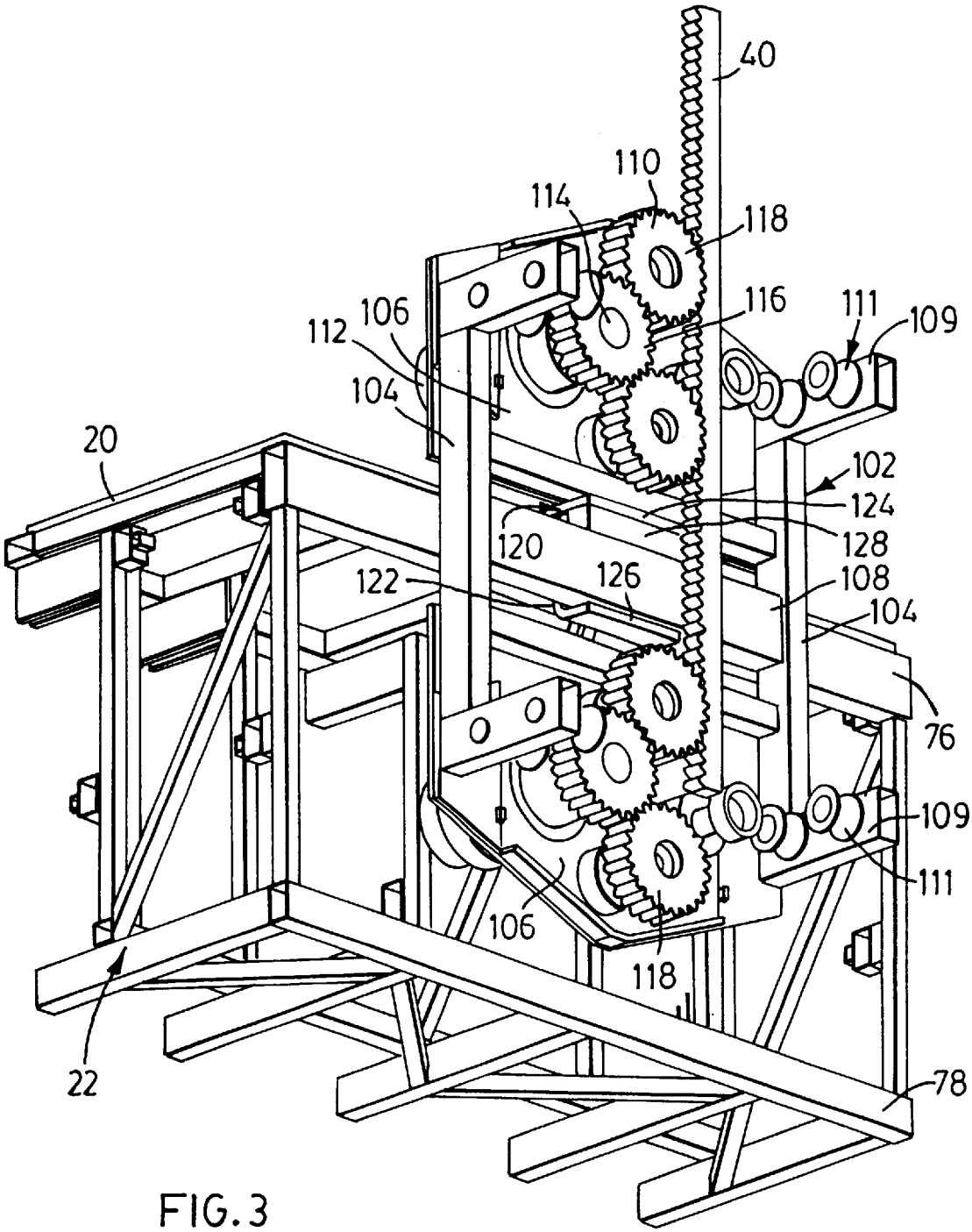
FIG. 3 is an isometric view of a portion of FIG. 2 showing the coupling between the motor trolley and the elevating platform.
Figure 4:
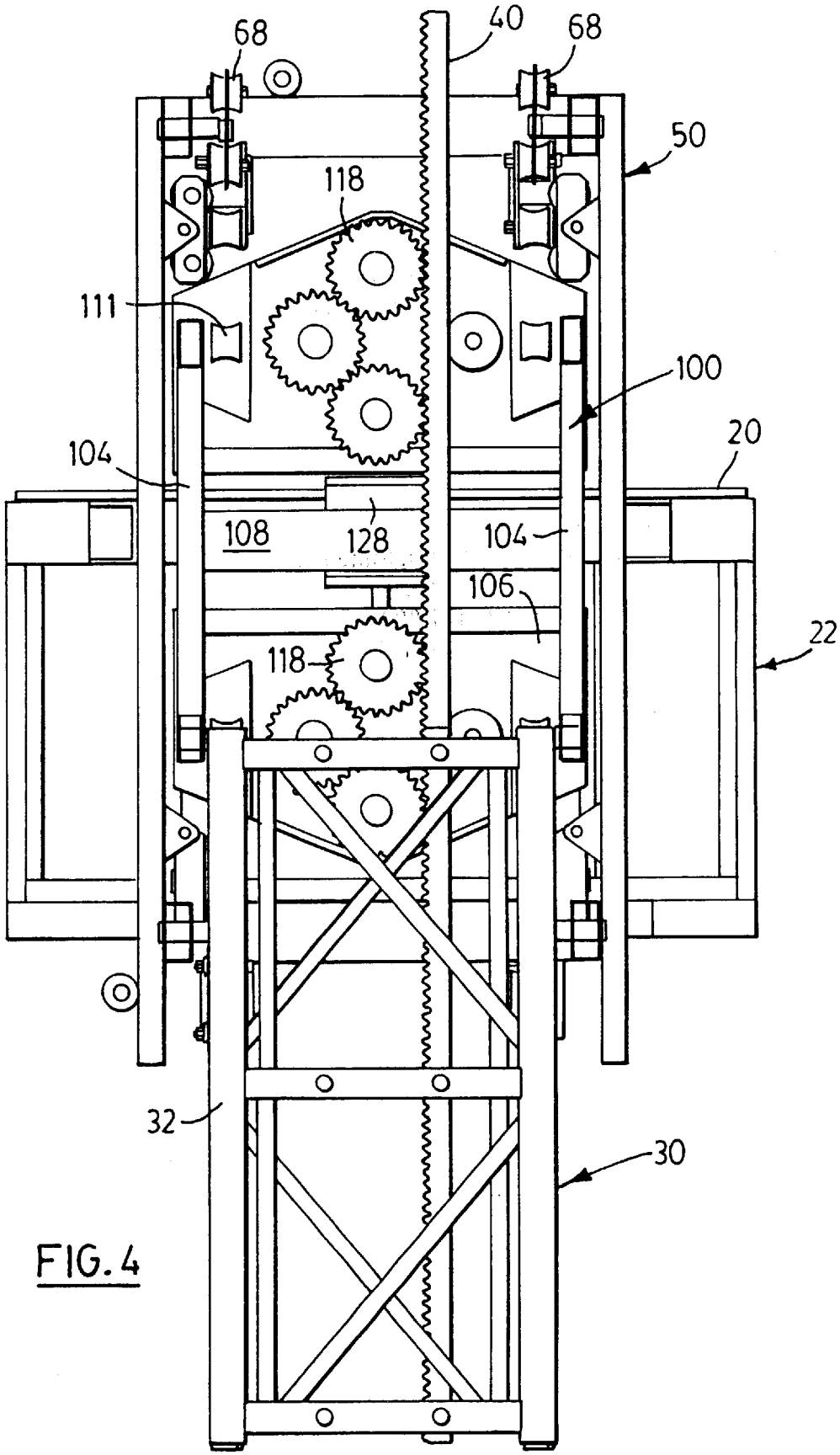
FIG. 4 is a side elevational view of FIG. 2.

Nested within the main trolley 50 is a motor trolley 100 (best illustrated in FIG. 3). As can be seen, the motor trolley 100 includes a generally rectangular frame structure 102 including a pair of vertical side members 104 joined at their upper and lower ends by supporting plates 106. A horizontal member 108 spans the side members 104 intermediate the supporting plates 106. A roller set support 109 is positioned at each corner of the frame structure 102 and extends inwardly towards the mast 12. A set of rollers 111 is mounted on each support 109. The rollers 111 on the supports 109 surround and engage the rails 32.

A drive mechanism 110 is mounted on each supporting plate 106. Each drive mechanism 110 includes a motor 112 having an output shaft 114. Shaft 114 extends through a bushing on the supporting plate 106 and has a gear 116 keyed to its other end. Gear 116 engages a pair of vertically spaced pinions 118 that are in mating engagement with the rack 40. Rotation of the shafts 114 by the motors 112 imparts rotation of the pinions 118 via the gears 116. This of course allows the motor trolley 100 to advance along the rack 40 and hence, along the mast 12.

A shock absorbing arrangement acts between the framework 22 of the elevating platform 16 and the motor trolley 100 to provide a floating couple therebetween. As can be seen, the shock absorbing arrangement includes a C-shaped member 120 having a web 122 and upper and lower limbs 124 and 126 defining a channel therebetween. The web 122 is welded to the main upper beam 76 of the framework 22. An elastomeric shock absorbing element 128 is secured to the upper limb 124 and is positioned within the channel. The cross member 108 of the motor trolley 100 is accommodated within the channel and forms an interference fit with the elastomeric shock absorbing element 128 and the lower limb 126.

In operation, when the motors 112 are actuated to rotate the shafts 114 and hence the gears 116, the rotation of the gears 116 imparts rotation of the pinions 118. Since the pinions 118 are in mating engagement with the rack 40, as the pinions 118 rotate, the pinions 118 advance along the rack 40 causing the motor trolley 100 to move along the mast 12. The direction in which the motor trolley 100 advances along the mast 12 of course depends on the direction the shafts 114 are rotated. As mentioned above, the framework 22 of the elevating platform 16 is coupled to the motor trolley 100 via the shock absorbing arrangement. Therefore, the elevating platform 16 moves with the motor trolley 100 as a unit.

During use, the elevating platform 16 may be heavily loaded. If the load is positioned on the elevating platform 16 away from the mast 12, the loading on the elevating platform 16 may create a significant moment at the point of connection between the elevating platform and the mast 12. As the elevating platform 16 pivots under the load and the lower limb 126 of the C-shaped member 120 pushes against the cross member 108, the cross member 108 contacts the shock absorbing element 128. The shock absorbing element 128 in turn deforms allowing the elevating platform to pivot relative to the motor trolley 100. In this manner, significant forces that act to pull the motor trolley 100 away from the mast 12 are not imparted on the motor trolley 100 by the elevating platform. Thus, the pinions 118 and rack 140 remain in alignment despite the loads placed on the elevating platform 16.

Figure 5:
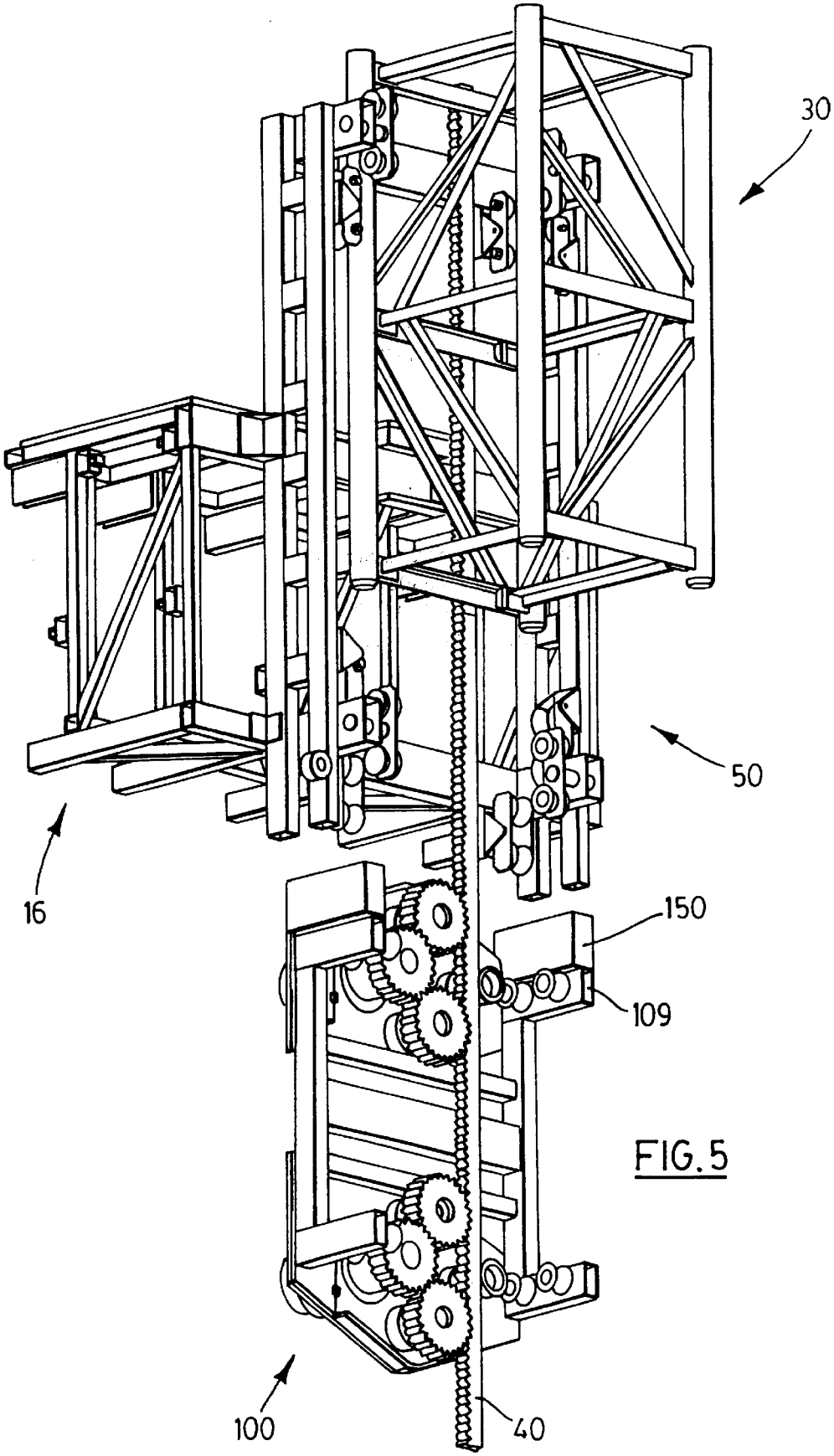
FIG. 5 is an isometric view of another embodiment of a motor trolley, main trolley and elevating platform arrangement.

Turning now to FIG. 5, an alternative motor trolley and main trolley arrangement for the elevating platform assembly 10 is shown. In this embodiment, the configurations of the motor trolley 100 and the main trolley 50 are the same as those described with reference to the first embodiment; however, the two trolleys are not nested. Instead, the motor trolley 100 is positioned below both the main trolley 50 and the elevating platform 16 with the main trolley 50 resting on the motor trolley 100. Elastomeric elements 150 are mounted on the top roller set supports 109 of the motor trolley 100 and act between the motor trolley 100 and the main trolley 50. Since the motor trolley 100 and the elevating platform 16 are not coupled directly, moments at the mast 12 that are caused by loads placed on the elevating platform 16 are not transferred to the motor trolley 100. As a result, the pinions 118 and rack 40 remain in alignment regardless of the loads placed on the elevating platform 16.

As will be appreciated, by avoiding a fixed rigid connection between the motor trolley 100 and the elevating platform 16, significant moments resulting from loading of the elevating platform 16 are not transferred to the motor trolley 100. This of course maintains the rack 40 and pinions 118 in alignment reducing the likelihood of stripping of the pinions.

Although the elevating platform assembly is shown having a single elevating platform extending from one side the mast, those of skill in the art will appreciate that the elevating platform assembly may include an additional elevating platform extending from the opposite side of the mast. The second elevating platform may be coupled to the first elevating platform and driven by the drive mechanism of the first elevating platform or may include its own motor trolley and drive mechanism. In this latter case, a second rack is provided on the mast 12.

Although preferred embodiments of the present invention have been described, those of skill in the art will appreciate that variations and modifications may be made without departing from the spirit and scope thereof as defined by the appended claims.

I claim:

1. An elevating platform assembly comprising:

a generally vertical mast having a generally vertical rack mounted thereon;

a first trolley coupled to said mast and being moveable therealong;

a drive mechanism carried by said first trolley, said drive mechanism including at least one pinion in mating engagement with said rack; and an elongated elevating platform extending from said mast and having a second trolley mounted adjacent one end thereof, said second trolley coupling said elevating platform to said mast and being moveable along said mast, wherein said first trolley is coupled to at least one of said second trolley and said elevating platform in a manner to maintain alignment of said at least one pinion and rack when loads are placed on said elevating platform that create moments at said mast.

2. An elevating platform assembly according to claim 1 wherein said first trolley is coupled to said elevating platform.

3. An elevating platform assembly according to claim 2 wherein a floating couple acts between said first trolley and said elevating platform.

4. An elevating platform assembly according to claim 3 wherein said floating couple includes an elastomeric element acting between said first trolley and said elevating platform.

5. An elevating platform assembly according to claim 4 wherein said elastomeric element is carried by a C-shaped member on said elevating platform, said C-shaped member receiving a cross member on said first trolley.

6. An elevating platform assembly according to claim 5 wherein said cross member forms an interference fit with said elastomeric element and a limb of said C-shaped member.

7. An elevating platform assembly according to claim 1 wherein said first trolley is positioned on said mast below said second trolley, said second trolley resting on said first trolley.

8. An elevating platform assembly according to claim 7 wherein shock absorbing elements are carried by at least one of said first and second trolleys and act between said first and second trolleys.

9. An elevating platform assembly according to claim 8 wherein said shock absorbing elements are carried by said first trolley.

10. An elevating platform assembly comprising:

an upright mast having a vertical rack extending along at least one side thereof;

a motor trolley coupled to said mast, said motor trolley carrying a drive mechanism including at least one rotatable pinion in mating engagement with said at least one rack, rotation of said at least one pinion advancing said motor trolley vertically along said mast;

an elongated elevating platform extending from said at least one side of said mast, said elevating platform including a generally horizontal work surface; and a main trolley acting between said elevating platform and said mast and being moveable vertically along said mast, wherein said motor trolley is coupled to one of said main trolley and said elevating platform in a manner so as to maintain alignment of said at least one pinion and said rack when loads are placed on said elevating platform.

11. An elevating platform assembly according to claim 10 wherein said motor trolley and said main trolley are nested and wherein said motor trolley is coupled to said elevating platform via a floating couple.

12. An elevating platform assembly according to claim 11 wherein said floating couple includes an elastomeric element carried by a C-shaped member on said elevating platform, said C-shaped member receiving a cross-member on said motor trolley.

13. An elevating platform assembly according to claim 12 wherein said cross member forms an interference fit with said elastomeric element and a lower limb said C-shaped member.

14. An elevating platform assembly according to claim 13 wherein said elevating platform includes a framework supporting said work surface and having an upper beam, said C-shaped member being secured to said upper beam.

15. An elevating platform assembly according to claim 14 wherein said motor trolley includes an upper pair of vertically spaced pinions and a lower pair of vertically spaced pinions, each of said pinions engaging said rack, said cross member being disposed between said upper pair and lower pair of pinions.

16. An elevating platform assembly according to claim 10 wherein said motor trolley is disposed on said mast beneath said main trolley, said main trolley resting on said motor trolley.

17. An elevating platform assembly according to claim 16 further including shock absorbing elements on at least one of said motor trolley and main trolley, said shock absorbing elements acting between said motor trolley and said main trolley.

18. An elevating platform assembly according to claim 17 wherein said shock absorbing elements are formed of elastomeric material and are disposed on the top of said motor trolley.

* * * * *